US005323555A

United States Patent [19]

Jehn

[11] Patent Number: 5,323,555

[45] Date of Patent: Jun. 28, 1994

[54] ADJUSTABLE LASER SIGHT

[76] Inventor: E. F. Jehn, 10F, No. 185, Yung Chi Road, Taipei, Taiwan

[21] Appl. No.: 963,210

[22] Filed: Oct. 19, 1992

[51] Int. Cl.[5] ..... F41G 1/36

[52] U.S. Cl. ..... 42/103

[58] Field of Search ..... 42/103, 100; 89/41.17, 89/41.19; 33/245, 241

[56] References Cited

U.S. PATENT DOCUMENTS

| | | | |
|---|---|---|---|
| 618,161 | 1/1899 | Brightmore | 33/245 |
| 3,297,389 | 1/1967 | Gibson | 33/245 |
| 3,826,012 | 7/1974 | Pachmayr | 42/100 |
| 4,859,058 | 8/1989 | Ekstrand | 33/241 |
| 4,876,816 | 10/1989 | Triplett | 42/103 |
| 4,939,863 | 7/1990 | Alexander et al. | 42/103 |
| 5,033,219 | 7/1991 | Johnson et al. | 42/103 |

FOREIGN PATENT DOCUMENTS

| | | | |
|---|---|---|---|
| 2602037 | 1/1988 | France | 42/103 |

OTHER PUBLICATIONS

Shooting Times, The Taurus/Laser Aim Package, Mar. 1990.

*Primary Examiner*—Stephen M. Johnson

*Attorney, Agent, or Firm*—Lowe, Price, LeBlanc & Becker

[57] ABSTRACT

An adjustable laser sight fastened to a gun and controlled to lase a laser beam through a laser module for aiding the eyes in lining up the gun on its objective. The laser sight includes a laser module adjustably retained in a taper hole inside a housing by two adjusting screws and two supporting springs, which are disposed in the form of a cross. The laser module is adjusted elevation by turning one adjusting screw inwards or outwards and adjusted windage by turning the other adjusting screw inwards or outwards.

1 Claim, 6 Drawing Sheets

ADJUSTABLE LASER SIGHT

BACKGROUND OF THE INVENTION

The present invention relates to an adjustable laser sight fastened to a gun and controlled to lase a laser beam for aiding the eyes in lining up the gun on its objective, which can be adjusted for windage as well as elevation by a respective adjusting screw.

Various laser sights are known and used to aid the eyes in lining up a gun or an optical instrument on its objective. Because regular laser sights are not adjustable on the laser firing point, they must be fastened to a gun or an optical instrument by an adjustment frame for permitting the laser unit to be adjusted for elevation as well as windage. However, adding an adjustment frame to a gun will greatly increase the weight and the size of the gun. There is also disclosed an adjustable laser sight, as shown in FIGS. 1,2 and 3, which is generally comprised a laser unit (3*a*) supported on a spring plate (13*a*) inside a housing (1*a*) and connected to a battery (2*a*), and two adjusting screws (11*a*) (12*a*) respectively threaded into screw holes on the housing (1*a*) at right angles and stopped against the laser unit (3*a*). By turning the adjusting screws (11*a*) (12*a*) inwards or outwards, the laser unit (3*a*) is adjusted windage and elevation. This structure is still not satisfactory in function. Because the laser unit (3*a*) is made in a cylindrical shape and stopped in position by the spring plate (13*a*) and the two adjusting screws (11*a*) (12*a*) at three angles, it may move from position when it was shaken after each firing of the gun onto which the laser sight is mounted.

SUMMARY OF THE INVENTION

The present invention eliminates the aforesaid disadvantages. According to the preferred embodiment of the present invention, the laser unit is retained inside a housing by two adjusting screws and two supporting springs at right angles. The adjusting screws and the supporting springs are arranged into the form of a cross and stopped against a respective plane around the laser unit for permitting the laser unit to be firmly retained in position.

DETAILED DESCRIPTION OF THE PREFERRED EMBODIMENT

Figure 1:
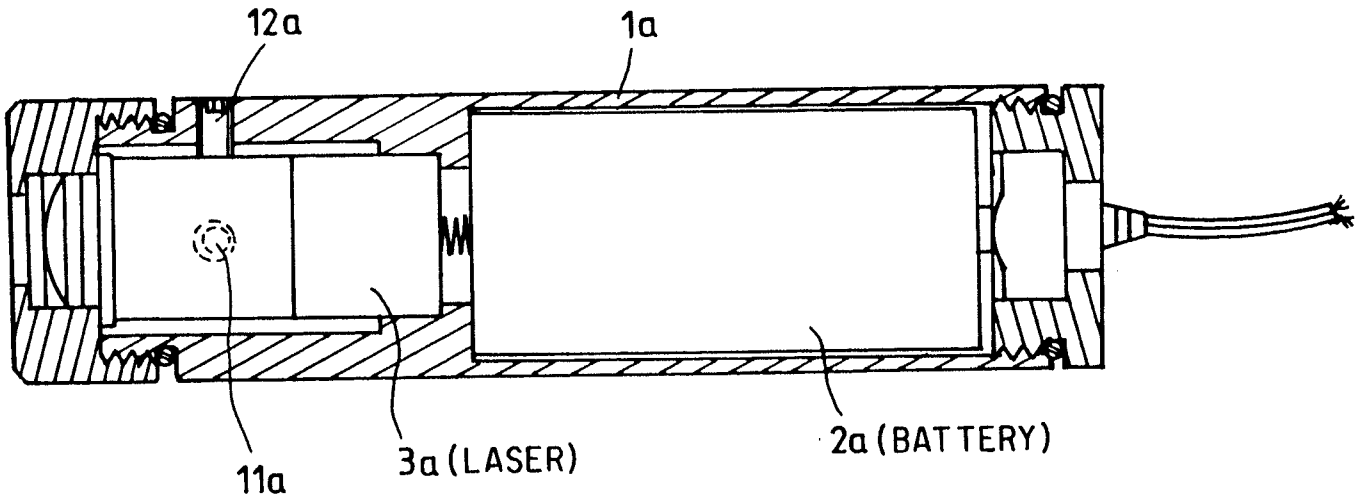
FIG.1 PRIOR ART
FIG. 1 is a longitudinal sectional view of a laser sight according to the prior art.
Figure 3:
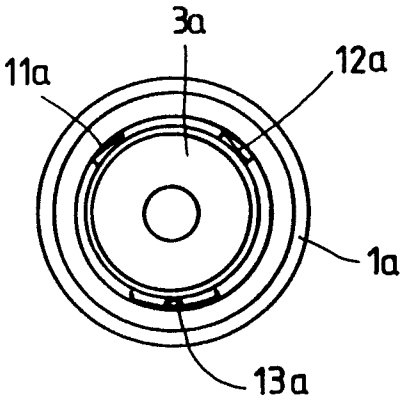
FIG.3 PRIOR ART
FIG. 3 is another sectional front end view of the laser sight of FIG. 1.
Figure 2:
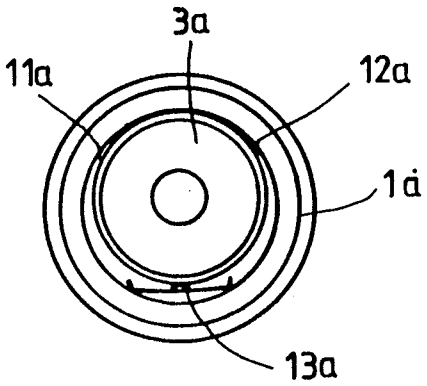
FIG. 2 PRIOR ART
FIG. 2 is a sectional front end view of the laser sight of FIG. 1.
Figure 4:
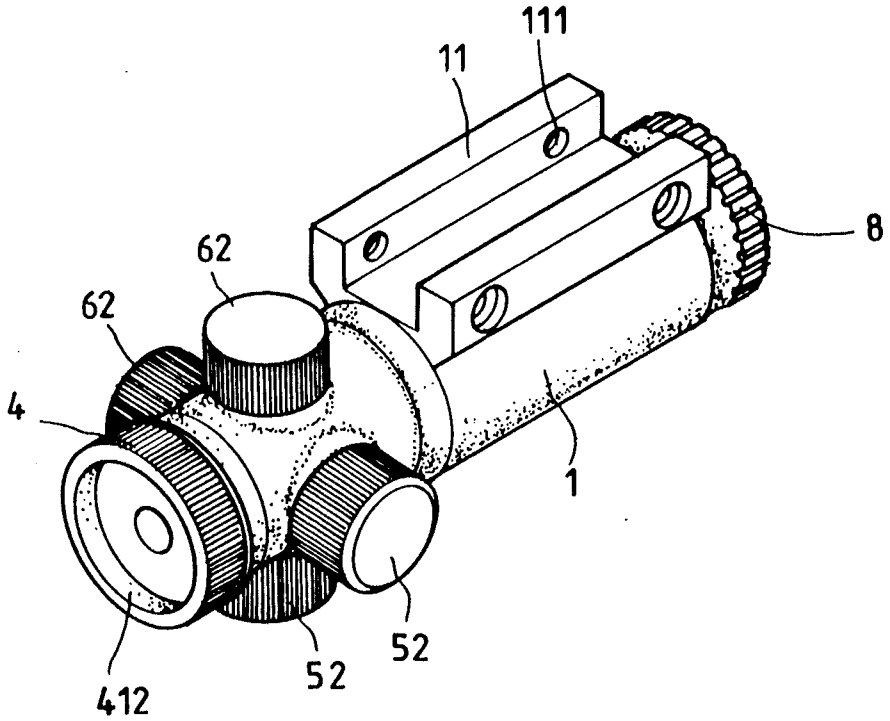
FIG. 4 is an elevational view of a laser sight embodying the present invention.
Figure 5:
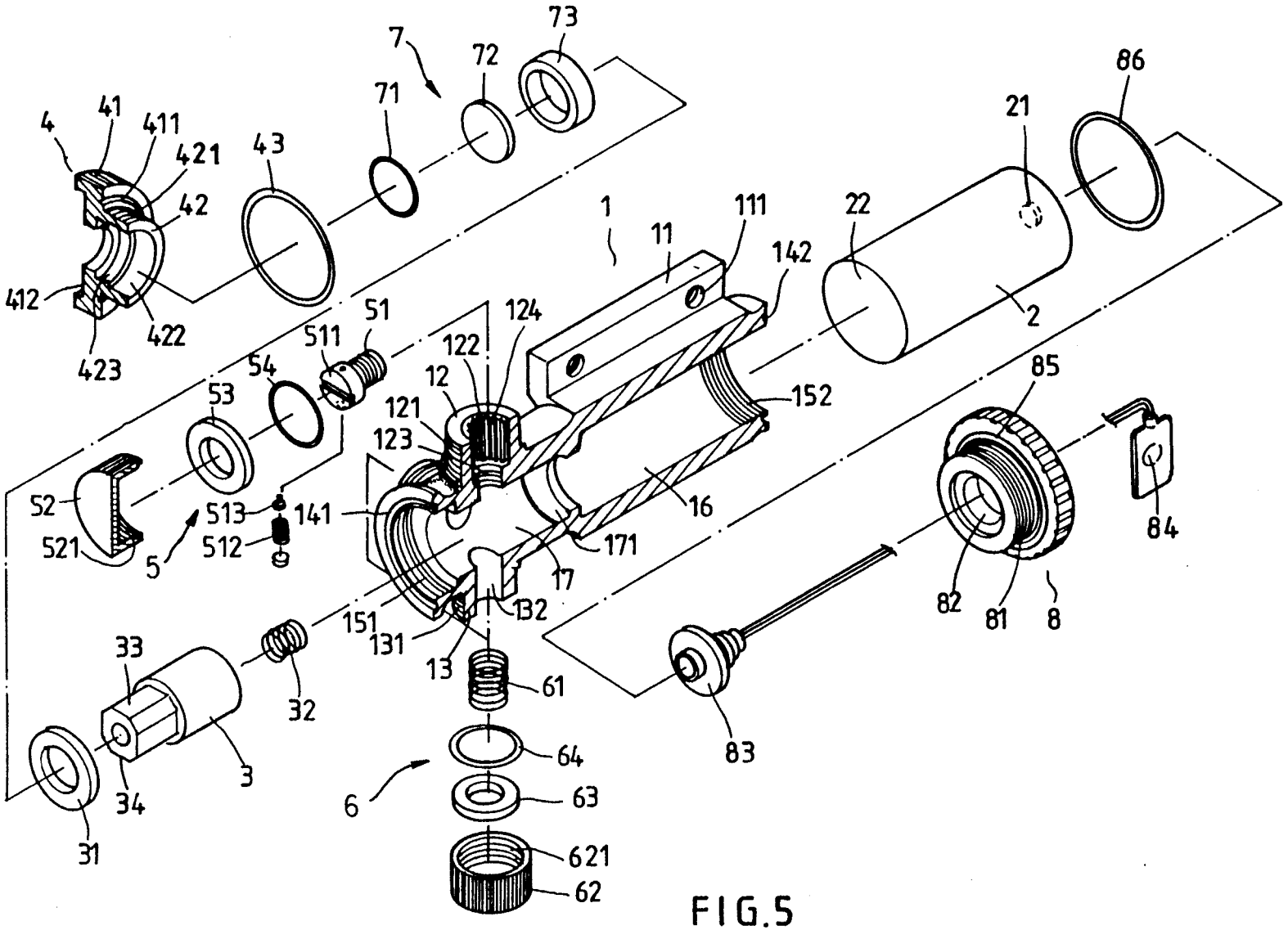
FIG. 5 is an exploded view of the laser sight of FIG. 4.
Figure 6:
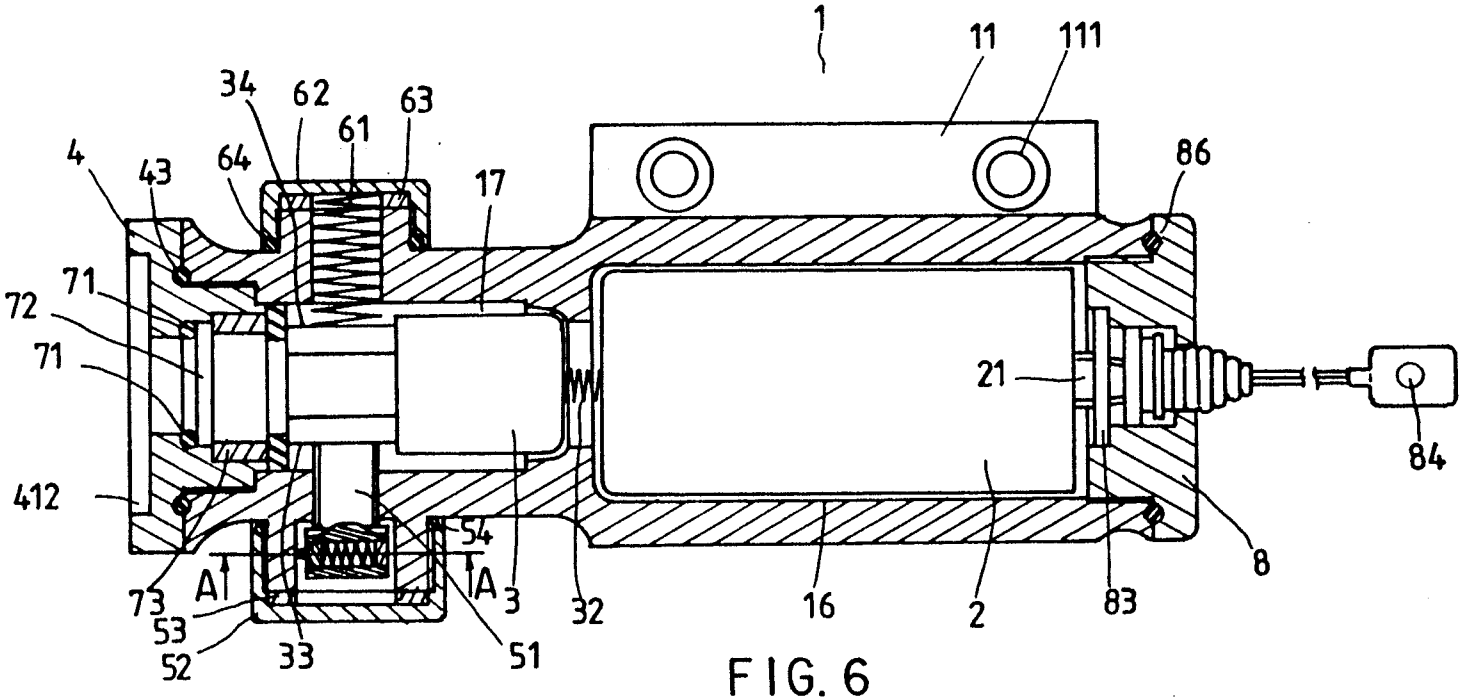
FIG. 6 is a longitudinal section of the laser sight of FIG. 4.
Figure 6A:
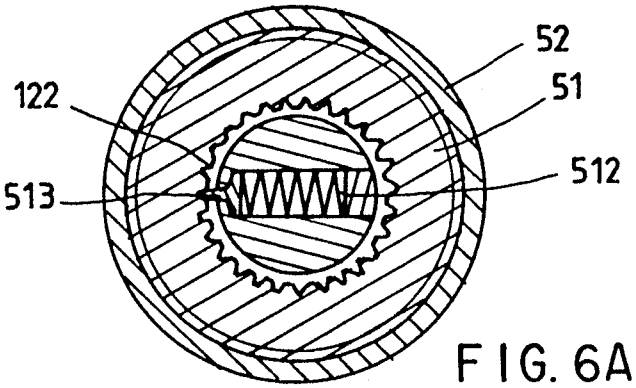
FIG. 6A is a cross section taken along lines A—A of FIG. 6 showing an adjustment unit in the tubular seat on the housing.

Referring to FIGS. 4,5 and 6, a laser sight as constructed in accordance with the present invention is generally comprised of a housing 1, a battery 2, a laser module 3, a front socket 4, two adjustment units 5, two spring assemblies 6, a laser window lens assembly 7, and a rear cap 8.

The housing 1 is made from a tube having a top channel support 11 with screw holes 111 for fastening to the mount of gun or an instrument by screws, two tubular adjustment seats 12 on the outside at right angles of which each comprises an outer thread 121, a plurality of vertical grooves 122 spaced around a hole 124 above an inner thread 123, two tubular spring seats 13 on the outside at right angles at locations symmetrical to the tubular adjustment seats 12 of which each comprises an outer thread 131 and an internal spring chamber 132, a front annular groove 141 and a rear annular groove 142 on two opposite end edges thereof, and a front inner thread 151 and a rear inner thread 152 on the inside wall thereof at two opposite locations adjacent to either annular groove 141 or 142, a rear chamber 16 for holding the battery 2, and a front chamber 17 for holding the laser unit 3. The front chamber 17 has a rear end terminated into a taper hole 171 in communication with the rear chamber 16.

The front socket 4 is made in a stepped structure formed into a front big ring 41 and a rear small ring 42. The rear small ring 42 has an outer thread 421 threaded into the front inner thread 151 of the housing 1 and sealed by a seal ring 43, and an inside spaced formed into a first chamber 422 and a second chamber 423. The front big ring 41 has an annular groove 411 around the peripheral surface thereof, and a front countersunk hole 412.

The two adjustment units 5 are respectively fastened to the two tubular adjustment seats 12 for windage and elevation adjustments. Each adjustment unit 5 comprises an adjusting screw 51 threaded into the inner thread 123 on either tubular adjustment seat 12, a rod member 513 retained is the slotted head 511 of the adjusting screw 51 by a spring 512 and locked in either vertical groove 122 on the respective tubular adjustment seat 12, a cap 52 having an inner thread 521 threaded onto the outer thread 121 on either tubular adjustment seat 12, and a cushion ring 53 and a seal ring 54 sealed between the adjustment cap 51 and the respective tubular adjustment seat 12.

The spring assemblies 6 are respectively fastened to the, two tubular spring seats 13. Each spring assembly 6 comprises a spring 61 received inside the internal spring chamber 132 on either tubular spring seat 13, a cap 62 having an inner thread 621 threaded onto the outer thread 131 on the respective tubular spring seat 13, and a cushion ring 63 and a seal ring 64 sealed between the cap 62 and the respective tubular spring seat 13.

The laser window lens assembly 7 comprises an O-ring 71 retained in between the annular groove 411 on the front socket 4 and the front annular groove 141 on the housing 1, a laser window lens 72 and a lens locating ring 73 respectively fastened in the second chamber 423 and the first chamber 422 of the rear small ring 42 of the front socket 4. One of the main functions of this arrangement is to protect the internal laser module against moisture and smoke.

The rear cap 8 has an outer thread 81 threaded into the rear inner thread 152 on the housing 1, an annular groove 85 around a peripheral surface thereof behind the outer thread 81 onto which a seal ring 86 is mounted and sealed between the housing 1 and the rear cap 8, and a circular through hole 82 through the central axis thereof. There is also provided a positive switch contact 83 disposed in contact with the positive terminal 21 of the battery 2 and extended out of the rear cap 8 through the circular through hole 82 and connected to a press button switch 84.

The laser module 3 is received inside the front chamber 17 of the housing 1 and retained between a cushion ring 31 and a small spring 32. The cushion ring 31 is retained between the laser module 3 and the lens locating ring 73. The small spring 32 is retained in the taper hole 171 and connected between the negative terminal 22 of the battery 2 and the laser module 3.

When the aforesaid parts are assembled into a laser sight, as shown in FIGS. 4 and 6, the adjusting screws 51 of the two adjustment units 5 are stopped against a respective rectangular plane 33 or 34 on the laser module 3 against the the spring 61 of either spring assembly 6. Therefore, the laser module 3 can be adjusted windage as well as elevation by removing the cap 52 from the respective adjustment unit 5 and rotating the adjusting screw 51 inwards or outwards. Because the laser module 3 has a front end made in the shape of a polygonal column, it is firmly stopped in position by the two adjusting screws 51 of the two adjustment units, 5 and the two springs 61 of the two spring assemblies 6.

Figure 7:
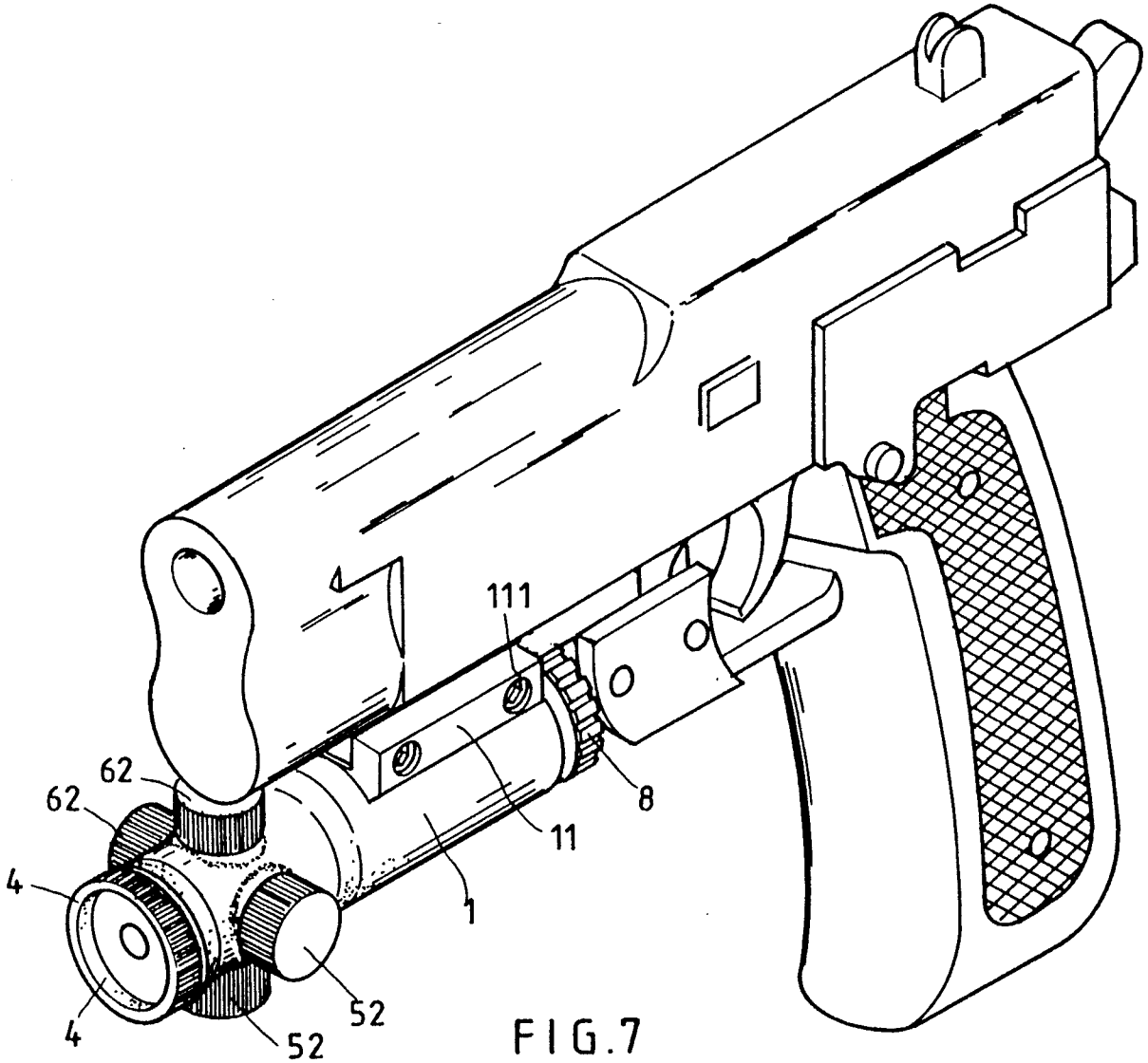
FIG. 7 is an installed example showing the laser sight of FIG. 4 used with a pistol.

Referring to FIG. 7, therein illustrated is an installed example showing the laser sight fastened to a pistol and used to add the eyes in lining up the pistol on its objective.

What is claimed is:

1. A laser sight for aligning a gun with a target comprising: a cylindrical housing adapted to be mounted on said gun; a laser module mounted within said housing, a laser lens mounted in said housing, and control means coupled to said module for directing a laser light associated with said laser module through said lens to assist in alignment with a target; said module having a rear end adjustably retained in a tapered hole in said housing and a polygonal front end; first and second pairs of tubular seats on said housing adjacent the polygonal front end of said module and spaced around the periphery thereof at 90° integrals; a pair of adjustment screws in an adjacent pair of said tubular seats and a pair of supporting springs disposed in the other adjacent pair of said tubular seats, extending radially inwardly, normally engaging said polygonal end with one screw of said screws opposite each said spring, a retaining cap disposed on an end of each tubular seat opposite said housing;

said pair of tubular seats retaining said screws having interior surfaces and a plurality of longitudinal grooves extending around each of said interior surfaces; each said adjustment screw having a slotted head portion with a laterally extending hole therethrough; a biased pin disposed in each of said laterally extending holes, having a head portion normally extending therefrom and engaging the interior surface of said tubular seat at said grooves, said laser module being adjustable in elevation by rotating one of said screws and in windage by rotation of the other of said screws, rotation being accompanied by audible clicks as the head portions of said pins rotate along the grooves.

* * * * *